United States Patent [19]

Theilen

[11] 4,313,682

[45] Feb. 2, 1982

[54] FINAL POSITIONING VIBRATION DAMPING DEVICE FOR TYPE DISC TYPEWRITERS

[75] Inventor: Rolf Theilen, Furth, Fed. Rep. of Germany

[73] Assignee: Triumph-Adler Aktiengesellschaft fur Buround Informationstechnik, Nuremberg, Fed. Rep. of Germany

[21] Appl. No.: 183,978

[22] Filed: Sep. 4, 1980

[30] Foreign Application Priority Data

Feb. 26, 1980 [DE] Fed. Rep. of Germany ..... 3007108

[51] Int. Cl.[3] ..... B41J 1/32

[52] U.S. Cl. ..... 400/144.3; 101/93.02

[58] Field of Search ..... 400/144.2, 144.3, 144.1, 400/144.4; 101/93.02, 93.19

[56] References Cited

U.S. PATENT DOCUMENTS 3,698,529 10/1972 Cattaneo ..... 400/144.3
3,773,161 11/1973 Bossi ..... 400/144.3
3,840,105 10/1974 Kittredge ..... 400/144.3
3,970,186 7/1976 Sohl et al. ..... 400/144.3

OTHER PUBLICATIONS

"Typewriter Hammer/Print Wheel System", Berger Xerox Discl. Journal, vol. 1, No. 4, Apr. 1976, pp. 39–40.

*Primary Examiner*—E. H. Eickholt

[57] ABSTRACT

Disclosed is a device for use in type disc typewriters or similar machines having types carried by spokes radially extending from a common hub which is rotated to position a selected spoke at a print position. The device is operative to lock the type disc at the selected position and to restrain vibration of spokes adjacent to the spoke at the printing position. To this end there is provided a lever which acts against the hammer side of the type disc shortly before the printing of the selected type to displace the selected type spoke and interpose itself between adjacent type spokes to either side of the selected type spoke to preclude axial as well as circumferential vibration of the type disc.

5 Claims, 4 Drawing Figures

Fig_1
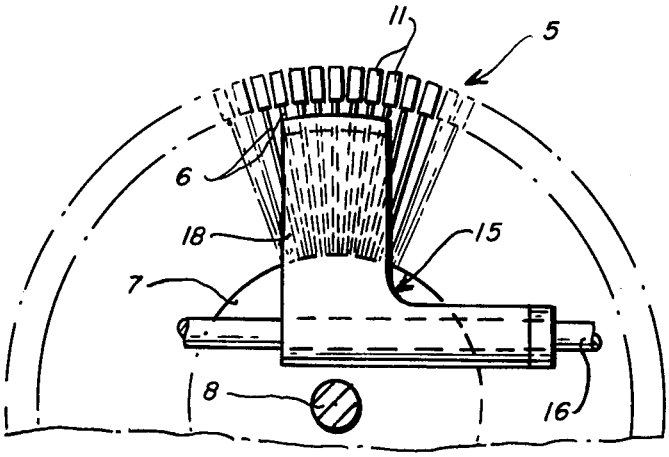
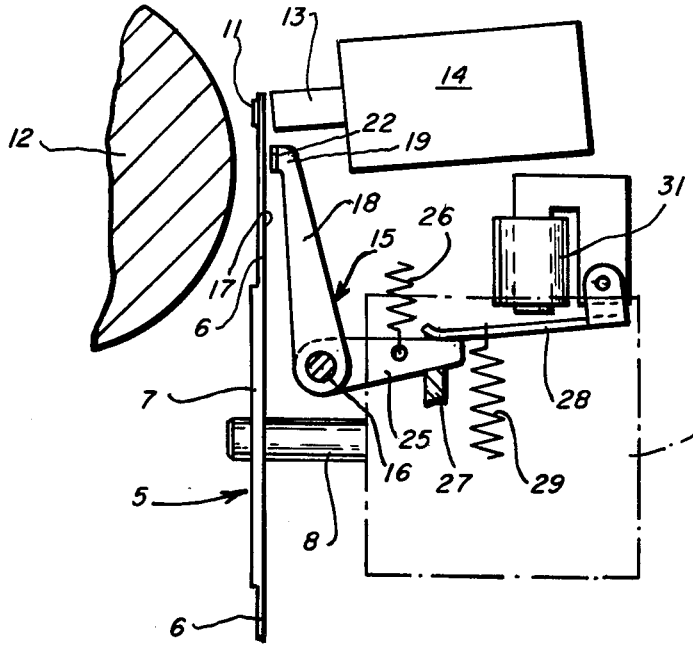
Fig_2
Fig_3
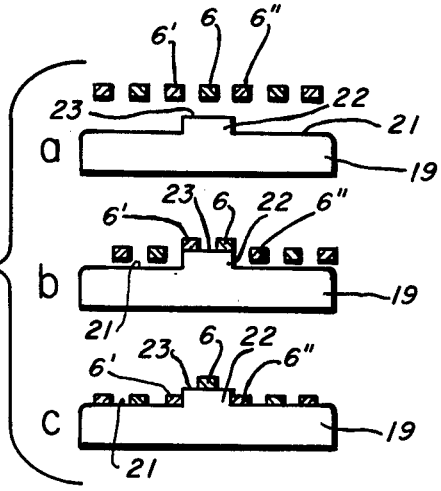
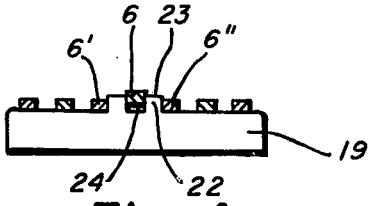
Fig_4

FINAL POSITIONING VIBRATION DAMPING DEVICE FOR TYPE DISC TYPEWRITERS

The invention relates to type disc typewriters; more particularly it relates to final positioning structure for damping type disc vibration and for aligning and locking the type disc at a selected position in advance of printing.

Type discs characterized by a plurality of spokes, which carry characters at their ends, are frequently driven to selected positions for example, by stepping motors. Such motors, depending on controls therefore, do not always stop exactly in the desired position, but vibrate or oscillate about the desired position. In addition, lateral vibration of the individual type wheel spokes are superimposed on the vibrations of the motor shaft caused by rotary movements. Accordingly, the time required to allow vibration of the type wheel or the type wheel spokes to stop before a printing hammer can be actuated is lost and as a result typing speed is limited.

As shown in DOS No. 23 47 640, to align or finally position a selected type spoke at the desired position following positioning movement there is provided on the side of the type heads facing the printing hammer wedge-shaped lugs, for cooperation with a printing hammer having a correspondingly shaped centering cut which acts to center the characters preset in the desired printing position. The printing process, which coincides with the aligning process, starts only when the torsional vibrations have died out to such an extent that a good entrance of the wedge-shaped lug of the type head into the cut of the printing hammer is ensured. Additional disadvantages reside in the fact that the moment of inertia of the type wheel is increased by the wedge-shaped lugs and the path of the hammer increases by the height of the wedge-shaped lug.

Also as shown in U.S. Pat. No. 3,840,105 a type disc having spokes with wedge-shaped aligning lugs is supplemented by an elastic guide bar extending transverse to the spokes of the type wheel. The function of the guide bar is to damp axial or lateral vibrations of the flat metallic laminations in printing direction in order to avoid collisions with the printing hammer. Though damping of the torsional or rotary vibrations of the type wheel can also be achieved by friction, the constant pressure of the bar on the type disc results in increased power consumption of the motor and in wear on the type disc. This type disc too has a higher moment of inertia, due to the wedge-shaped lugs.

As shown in DOS N. 24 48 019 and its corresponding U.S. Pat. No. 3,983,985, a type disc is associated with an aligning arm pivotally mounted between the type disc and a record medium. The aligning arm carries at its free end an aligning recess which is centered on the printing point and is moveable perpendicularly to the platen. Each spoke of the type disc has a neck with a wedge-shaped profile for association with the corresponding recess in the aligning arm when the selected character spoke is touched and is guided by it. This centering or aligning device does not serve to damp the torsional or rotary vibrations before the printing hammer is actuated and is elaborate in its many moving parts.

Measurements have shown that with a relatively simple stepping motor control, about 25 milliseconds must be allowed to elapse before vibrations have died down to such an extent that a character spoke, even when provided with the wedge-shaped lug, can engage the printing hammer provided with a V-cut.

In accordance with the invention there is provided an aligning and vibration damping device which moves against the type disc after a positioning movement in advance of hammer movement to align the selected spoke on the type disc, lock the type disc against rotary movement and to move against spokes adjacent to the selected spoke thereby to snub out lateral or axial vibrations.

An object of the invention is to provide a type disc printer wherein rotary oscillations of the type disc following a positioning movement and lateral vibrations of the spokes of the type disc are damped quickly allowing printing of type on a selected spoke substantially immediately following positioning movement.

Another object of the invention is in the provision of an aligning and vibration damping means moveable against the face of a type disc following positioning movement and in advance of printing.

Other objects, features and advantages of the present invention will become known to those skilled in the art from a reading of the following detailed description when taken in conjunction with the accompanying drawing wherein like reference numerals designate like or corresponding parts throughout the several views thereof, and wherein:

FIG. 1 is an elevational view of the type disc from the side facing the printing hammer;

FIG. 2 is a side elevation of the printing device;

FIG. 3 is a schematic view illustrating the damping and locking process provided with a nose having a flat face; and FIG. 4 is a schematic view of another embodiment provided with a nose having a guide recess in its face.

Referring now to FIGS. 1 and 2, there is shown a type wheel or disc generally designated by reference numeral 5 having an array of circumferentially spaced type bearing flexible spokes 6 radially extending from a central hub or axis 7 which is mounted on the shaft 8 of a stepping motor 9. The spokes 6 bear the type 11 on the free ends thereof and the type wheel 5 is located in a plane between a platen 12 and a printing hammer 13 which when axially moved as by an electromagnet means 14 strikes the spoke 6 positioned at the twelve o'clock position to drive the type 11 thereon against a printing point on the platen 12. A selected spoke 6 is positioned at the twelve o'clock position by the steeping motor 9 under control of electronic circuitry (not shown).

In accordance with the invention an aligning vibration damping means in the form of a lever generally designated by reference numeral 15, preferably made of plastic material, is pivotally mounted on a frame supported shaft 16 transverse the motor shaft 8 and located on the hammer or rear side 17 of the type disc 5. With reference to FIG. 2 the lever 15 has an arm 18 extending vertically which, at its upper end 19, is bent off in an axial direction toward the rear side 17 of the type disc 5. As shown in FIG. 3 the flat face 21 of the bent off end 19 is normally spaced from and parallel to the rear side 17 of the type disc 5. Also, the bent off end 19 is formed with a nose 22 extending axially from the center of the face 21 thereof with its flat face 23 also normally spaced from the spoke at the twelve o'clock position. As shown in FIGS. 1 and 3 the width of the bent off end 19 is such that its face 21 overlys an arc of the type disc 5 embracing several type spokes 6. The width of face 23 of the nose 22 corresponds substantially to the distance between two spokes 6' and 6'' separated by one and the depth of the nose 22 corresponds substantially to the thickness of the spokes 6.

FIG. 4 shows an alternative embodiment wherein the face 23 of nose 22 has a central recess 24 whose width corresponds to about half the height or depth of nose 22.

With reference again to FIG. 2, a second arm 25 of the lever 15 extends from pivot shaft 16 away from the rear side 17 of the type wheel 5 and is connected to a spring 26 under tension which, when lever arm 25 is released, will move lever 15 counterclockwise and lever arm 18 toward engagement with the rear side 17 of type disc 5. Lever arm 25 is releaseably held in a clockwise direction against a stop 27 by a pivoted lever 28 biased by a second spring 29 stronger than spring 26. The lever 28 is the armature of an electromagnet 31 which when energized pivots the lever 28 against opposition by spring 29 thereby to release lever arm 25 for movement by its biassing spring 26 so that the face 23 of the nose and the face 21 of the bent end 19 of the lever arm 18 engage the rear side 17 of the type disc 5 as shown in FIG. 3*c* and FIG. 4.

The operation is as follows: as soon as the stepping motor has completed rotation of the type disc 5 to position a selected spoke 6 at the nominal twelve o'clock position, electromagnet 31 is immediately energized and attracts armature lever 28 against the force of spring 29. This releases lever 15 to the action of spring 26 and lever end 19 strikes against spokes 6 of type disc 5 as shown in FIG. 3*c*. Assuming that type disc 5 shows a deviation due to oscillation from the twelve o'clock position at the time when lever 15 bears with its bent off end 19 on the rear side 17 of the type disc 5 as shown in FIG. 3*a*, nose 22 will engage two spokes 6 of type disc 5 (FIG. 3*b*). When type disc 5 now oscillates or moves back to the desired position, nose 22 will jump between spokes 6', 6'', to either side of the selected spoke 6 at the moment when type disc 5 reaches the desired position, and will urge selected spoke 6 in the direction of platen 12, until the entire face 21 of bent out end 19 bears on the six adjoining spokes as shown in FIG. 3*c* thereby locking the type disc 5 at the desired selected position and snubbing lateral vibrations of adjacent spokes 6.

The action of nose 22 with recess 24 in the embodiment of FIG. 4 is similar in that the nose 22 also enters between spokes to either side of a desired spoke 6 which is held within recess 24 following which the hammer is operated to print the character on the desired spoke 6.

After a character has been printed, magnet 31 is deenergized so that spring 29 can pull armature 28 and lever 15, into rest position against stop 27.

A considerable reduction of the waiting period between positioning and printing is thereby achieved with the disclosed simple and exact means for damping or suppressing torsional vibrations and for aligning the selected type. Also a type disc with a reduced moment of inertia due to elimination of any alignment lugs on the types, with the resulting shorter stroke of the printing hammer is permitted.

The invention claimed is:

1. In a typewriter or like machine having a platen, an axially movable printing hammer supported opposite a printing point on said platen, a type disc located between said platen and printing hammer having flexible spokes extending radially from a common axis, said spokes carrying type at the ends thereof on the side facing said platen, and means for rotating said type disc to present a selected spoke opposite said printing hammer, whereby printing hammer movement will impact the type on the selected spoke against said printing point, the improvement comprising aligning and vibration damping means mounted for movement toward the side of said type disc facing said print hammer to flex the spoke selectively positioned opposite the printing hammer toward said platen and to touchingly engage several spokes to either side of said selected spoke thereby to align said selective spoke and damp axial and rotary vibrations of said type disc, and means for moving said aligning and vibration damping means toward said type disc after a selected spoke has been positioned and in advance of printing hammer movement.

2. A typewriter as recited in claim 1, said aligning and vibration damping means including a lever pivotally mounted on an axis perpendicular to said type disc axis on the hammer facing side of said type disc, said lever having a free end movable toward the rear plane of said type disc and of a width to overly an arc embracing several spokes of said type disc, said free end having an axialy extending projection adapted to engage and flex the selected spoke toward said platen, said projection extending from said end a distance substantially equal to the thickness of a spoke and a width substantially equal to the distance between every other type spoke, whereby in flexing said selected spoke said projection moves between the spokes to either side of the selected spoke to lock the type disc at the selected position.

3. A typewriter as recited in claim 2, said means for moving said lever comprising a spring normally biasing said lever to move toward said type disc, and, means releasably holding said lever away from said type disc, said holding means being responsive to the positioning of a selected spoke for releasing said lever.

4. A typewriter as recited in claim 2, said projection being flat over its width.

5. A typewriter as recited in claim 2, said projection having a central recess whose width is that of a spoke.

* * * * *